US007406827B2

(12) United States Patent
Bernero et al.

(10) Patent No.: US 7,406,827 B2
(45) Date of Patent: Aug. 5, 2008

(54) APPARATUS FOR INJECTING A FUEL-AIR MIXTURE INTO A COMBUSTION CHAMBER

(75) Inventors: Stefano Bernero, Baden (CH); Weiqun Geng, Nussbaumen (CH); Christian Steinbach, Neuenhof (CH); Peter Stuber, Zürich (CH)

(73) Assignee: ALSTOM Technology Ltd, Baden (CH)

( * ) Notice: Subject to any disclaimer, the term of this patent is extended or adjusted under 35 U.S.C. 154(b) by 212 days.

(21) Appl. No.: 11/426,924

(22) Filed: Jun. 27, 2006

(65) Prior Publication Data

US 2008/0163626 A1 Jul. 10, 2008

Related U.S. Application Data

(60) Division of application No. 10/869,942, filed on Jun. 18, 2004, now Pat. No. 7,082,768, which is a continuation of application No. PCT/CH02/00675, filed on Dec. 6, 2002.

(30) Foreign Application Priority Data

Dec. 20, 2001 (CH) ..... 2331/01

(51) Int. Cl.
*F02C 1/00* (2006.01)
*F02G 3/00* (2006.01)

(52) U.S. Cl. ..... 60/742; 239/127.1; 431/162; 60/740

(58) Field of Classification Search ..... 60/740, 60/742, 748, 39.463; 431/162; 239/131, 239/127.1, 127.3, 398, 400
See application file for complete search history.

(56) References Cited

U.S. PATENT DOCUMENTS

| | | | | | |
|---|---|---|---|---|---|
| 2,959,003 | A | * | 11/1960 | Carlisle et al. | 60/742 |
| 3,684,186 | A | * | 8/1972 | Helmrich | 239/400 |
| 3,763,650 | A | * | 10/1973 | Hussey et al. | 60/39.463 |
| 3,777,983 | A | | 12/1973 | Hibbins | 239/422 |
| 3,788,067 | A | * | 1/1974 | Carlisle et al. | 60/742 |
| 3,979,069 | A | * | 9/1976 | Garofalo | 239/400 |
| 4,111,369 | A | * | 9/1978 | Sharpe | 239/400 |
| 4,139,157 | A | * | 2/1979 | Simmons | 239/400 |
| 4,260,367 | A | * | 4/1981 | Markowski et al. | 431/353 |
| 4,311,277 | A | | 1/1982 | Stratton | 239/400 |
| 4,595,143 | A | * | 6/1986 | Simmons et al. | 239/406 |
| 4,600,151 | A | * | 7/1986 | Bradley | 239/400 |
| 4,713,938 | A | | 12/1987 | Willis | 60/742 |
| 4,726,192 | A | | 2/1988 | Willis et al. | 60/737 |

(Continued)

FOREIGN PATENT DOCUMENTS

DE 44 24 597 A1 1/1996

(Continued)

*Primary Examiner*—William H Rodríguez
(74) *Attorney, Agent, or Firm*—Steptoe & Johnson LLP

(57) ABSTRACT

In a fuel lance by means of which fuels can be injected, via at least two separate passages, into a combustion chamber alternately or simultaneously at an injection location arranged substantially at the lance tip, reliable operation is achieved, without the risk of flashbacks and also without coking, by virtue of the fact that the fuel lance, in addition to fuel, also passes purge air to the injection location, and that the purge air, at the injection location, is routed between the two fuel systems, in such a manner that these systems are shielded from one another by the purge air.

20 Claims, 3 Drawing Sheets

U.S. PATENT DOCUMENTS

| | | | | | |
|---|---|---|---|---|---|
| 4,798,330 | A * | 1/1989 | Mancini et al. | 239/8 |
| 4,932,861 | A | 6/1990 | Keller et al. | 431/8 |
| 5,224,333 | A * | 7/1993 | Bretz et al. | 60/740 |
| 5,256,352 | A | 10/1993 | Snyder et al. | 261/78.2 |
| 5,259,184 | A | 11/1993 | Borkowicz et al. | 60/39.55 |
| 5,288,021 | A * | 2/1994 | Sood et al. | 239/132.5 |
| 5,337,961 | A * | 8/1994 | Brambani et al. | 239/397.5 |
| 5,408,830 | A | 4/1995 | Lovett | 60/737 |
| 5,588,826 | A | 12/1996 | Döbbeling et al. | 431/354 |
| 5,737,921 | A * | 4/1998 | Jones et al. | 60/740 |
| 5,761,907 | A * | 6/1998 | Pelletier et al. | 60/740 |
| 5,782,626 | A | 7/1998 | Joos et al. | 431/8 |
| 5,884,471 | A * | 3/1999 | Anderson et al. | 60/39.23 |
| 6,038,863 | A | 3/2000 | Keller et al. | 60/742 |
| 6,272,840 | B1 * | 8/2001 | Crocker et al. | 60/776 |
| 6,276,141 | B1 * | 8/2001 | Pelletier | 60/740 |
| 6,543,235 | B1 | 4/2003 | Crocker et al. | 60/776 |
| 6,622,488 | B2 * | 9/2003 | Mansour et al. | 60/740 |
| 6,715,292 | B1 * | 4/2004 | Hoke | 60/748 |
| 6,935,117 | B2 | 8/2005 | Cowan | 60/742 |
| 6,959,535 | B2 * | 11/2005 | Mancini et al. | 60/39.094 |
| 2007/0289306 | A1 * | 12/2007 | Suria et al. | 60/748 |

FOREIGN PATENT DOCUMENTS

| | | | |
|---|---|---|---|
| DE | 195 45 310 | A1 | 6/1997 |
| EP | 0 704 657 | A2 | 4/1996 |
| EP | 0 849 533 | A2 | 6/1998 |
| EP | 0 898 117 | A2 | 2/1999 |
| GB | 2 291 179 | | 1/1996 |

* cited by examiner

APPARATUS FOR INJECTING A FUEL-AIR MIXTURE INTO A COMBUSTION CHAMBER

CROSS-REFERENCE TO RELATED APPLICATIONS

This application is a divisional of U.S. application Ser. No. 10/869,942 filed Jun. 18, 2004, now U.S. Pat. No. 7,082,768 which is a continuation of the U.S. National Stage designation of co-pending International Patent Application PCT/CH02/00675 filed Dec. 6, 2002, and the entire contents of these prior applications are expressly incorporated herein by reference thereto.

FIELD OF THE INVENTION

The present invention relates to a method for injecting a fuel-air mixture into a combustion chamber.

BACKGROUND OF THE INVENTION

A method for injecting a fuel-air mixture into a combustion chamber is known from the document U.S. Pat. No. 6,038,863.

Premix burners, depending on the premixing quality, allow the NOx emissions from gas turbines to be greatly reduced. One problem in this context, however, is the relatively narrow operating range of premix burners. An additional flame is required for part-load operation even when swirl stabilization with vortex breakdown is employed, as are known, for example, in double-cone burners from U.S. Pat. No. 4,932,861 or in double-cone burners with downstream mixing section as described, for example, in EP 0704657. This part-load flame or pilot flame is generally diffusive in nature and should ideally be in as close proximity as possible to the (premix) main flame. Furthermore, it is necessary to take aerodynamic measures to avoid recirculation of fuel/air mix in the pilot fuel system during premix operation, since this mix can ignite and can thereby lead to overheating of the fuel lines.

DE-A1-44 24 597 discloses a combustion device. This combustion device is especially suitable for a gas turbine and comprises a combustion chamber with a number of burners operating in parallel. Liquid or gaseous fuel is supplied to these burners from the outside by means of replaceable plug-in fuel lances by way of corresponding liquid fuel supply ducts and/or gas supply ducts. Adjustable throttle locations are provided in the individual fuel lances of the burners for simple adjustment of the fuel distribution in the liquid fuel supply ducts or gas supply ducts.

DE-A1-195 45 310 discloses a premix burner. This premix burner for mixture of fuel and combustion air essentially comprises at least two partial cone shells with associated partial cone axes and inlet ducts for the combustion air. The premix burner is formed essentially of a straight hollow cone that is delimited by an outer cone jacket and an inner cone jacket and in that at least two inlet ducts are arranged tangentially to the inner cone jacket and arranged along a straight cone jacket line of the cone jacket. The partial cone axes of the partial cone shells formed in this way lie on a common cone axis.

U.S. Pat. No. 5,782,626 discloses an atomizer nozzle. In this airblast atomizer nozzle for operation of a burner that can be operated with liquid and gaseous fuels, the middle wall between the inner and outer air ducts is held by inner and outer support elements that have a sliding seat and can be formed as swirl blades. The atomizing edges of the airblast nozzle are angled in the direction of the nozzle axis. The nozzle is characterized by its small dimensions, low pressure loss and low tendency to coking.

SUMMARY OF THE INVENTION

The invention relates to a method for introducing two fuels, which are supplied separately from one another from a lance base, which is usually arranged at the back of the burner, to the injection location on the burner axis upstream of the vortex breakdown. The invention provides a method in which at least two separate fuels can be injected into a combustion chamber alternately or simultaneously at an injection location arranged substantially at the lance tip. It is possible for the combustion chamber to be operated with the two fuels simultaneously or alternately without any risk of flashbacks or coking (in the case of liquid fuel).

The invention relates to the fact that, at the injection location, the liquid fuel is injected in a manner that is directed slightly radially outward and onto the purge-air stream, i.e. in the form of an encircling, hollow, truncated circular cone that opens toward the lance tip and at the injection location, the gaseous fuel is injected in a manner that is directed slightly radially inward and onto the purge air stream.

Therefore, the invention relates to the purge air that is also supplied to the lance tip being routed between the fuels injected into the combustion chamber at the lance tip in such a manner that a "protective screen" of purge air prevents the two fuels from crossing one another. This in particular makes it impossible, when the lance is being operated with just one fuel, for fuel to enter that fuel passage which is not currently actuated with fuel.

According to the invention, the two passages for the fuels and the passage for the purge air are formed as substantially concentric cylindrical tubes of different diameters, wherein the three media are routed to the injection location in the hollow-cylindrical or cylindrical spaces that are thereby formed. This design is simple and particularly suitable with regard to the thermal loads in a burner.

The fuel systems are a system comprising liquid fuel and a system comprising gaseous fuel. In this case, the gaseous fuel is typically used for the part-load range in gas operation, and the liquid fuel, for example in the form of an oil, is used for the full load range in oil operation. In this case, the liquid fuel is routed to the lance tip via a central, inner tube having the smallest diameter, this inner tube being surrounded by two further tubes, which are arranged concentrically with respect to the inner tube, and the gaseous fuel and the purge air are routed to the injection location at the lance tip in the hollow-cylindrical spaces that are formed thereby, and furthermore the purge air, directly at the injection location, flows within the cavity between the central, inner tube and the middle tube. This ensures that the purge air, at the location of injection, effectively flows between the two fuel steams as a shielding jacket, so as to decouple the two fuel streams from one another.

The fuel lance is also characterized in that, at the injection location, the purge air is injected into the combustion chamber in a substantially axial and encircling manner, in the sense of a hollow cylinder. In other words, the purge air enters the combustion zone parallel to the burner axis. In this case, the injection of the liquid fuel occurs in a manner that is directed slightly radially outward and onto the axial purge-air stream, i.e. in the form of an encircling, hollow, truncated circular cone that opens out toward the lance tip. The liquid fuel can also be injected at this location through a hollow-cone swirl nozzle or through a multi-hole nozzle. At the injection location, the gaseous fuel may be injected in a manner that is directed slightly radially inward and onto the purge-air stream, i.e. in the form of an encircling, hollow, truncated circular cone that closes toward the lance tip.

Another preferred embodiment of the method according to the invention is characterized in that the liquid fuel and the gaseous fuels, at the lance base, are routed in the inner tube and in the cavity between the inner tube and the middle tube, respectively, and the purge air is routed in the cavity between the middle tube and the outer tube. In this case, it is on the one hand possible for the purge air to be diverted into the cavity between the inner tube and the middle tube directly at the lance base, while the gaseous fuel is passed into the cavity between the middle tube and the outer tube, in which case the purge air is particularly preferably introduced into the middle cavity through bores or slots arranged in corresponding radial segments. Since the lance tip may usually have a greater diameter at the lance base, this design allows greater flows of purge air and of gaseous fuel.

On the other hand, it is possible for the purge air only to cross the routing of the gaseous fuel at the lance tip, i.e. the purge air is routed to the lance tip in the cavity between the middle tube and the outer tube, and in the region of the lance tip the purge air is diverted into the middle cavity between the inner tube and the middle tube, whereas the gaseous fuel is passed into the outer cavity between the middle tube and the outer tube. Although this design usually only allows slightly lower streams of purge air and gaseous fuel, on account of the reduced dimensions of the lance tip, it does have the advantage that the purge air within the outermost passage simultaneously has a cooling effect and thereby is additionally responsible for preventing excessive heating, with associated flashbacks.

Furthermore, the present invention relates to the use of a method as described above. It relates in particular to a use of this nature for pilot operation of a premix burner, in particular of a double-cone burner with or without downstream mixing section, with the fuel lance then being arranged on the axis of the premix burner.

According to a first preferred embodiment of the said use, the lance extends substantially over a length of ¾ of the total length of the double-cone burner with or without downstream mixing section, in which context the overall length is to be understood as meaning the length of the conical region of the double-cone burner.

BRIEF DESCRIPTION OF THE DRAWINGS

The invention is to be explained in more detail below on the basis of exemplary embodiments and in conjunction with the drawings, in which.

Only the elements that are pertinent to the invention are illustrated. Identical elements are provided with identical reference numerals throughout the various figures. Directions of flow are indicated by arrows.

DETAILED DESCRIPTION OF THE PREFERRED EMBODIMENTS

Figure 1:
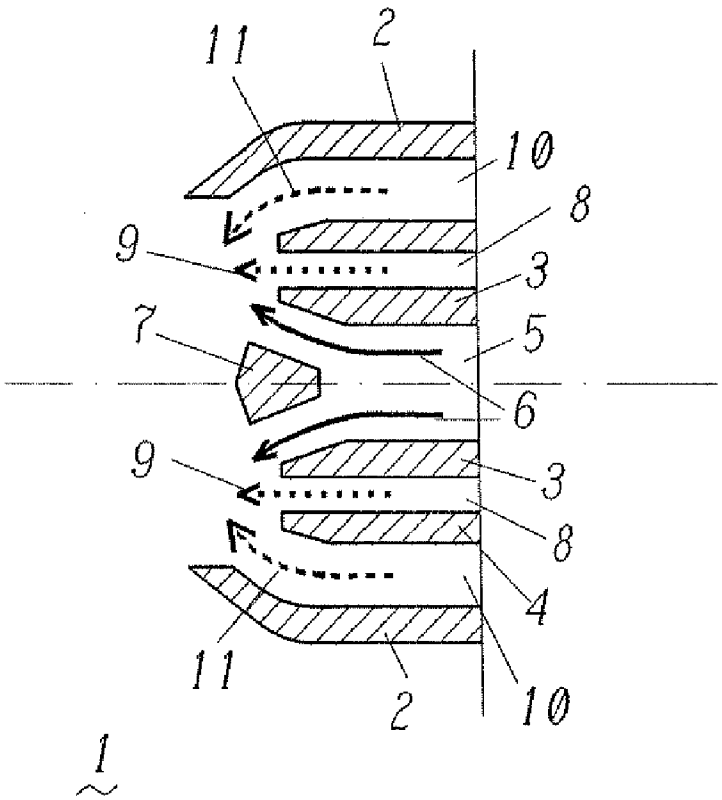
FIG. 1 shows an axial section through a fuel lance according to the invention.

FIG. 1 shows the lance tip 1 of a fuel lance in the form of an axial section. The fuel lance comprises an outermost lance tube 2, with the lance, in the case of its use in a double-cone burner, as known for example, from U.S. Pat. No. 4,932,861, usually projecting into the cavity between the conical part-bodies over approximately ¾ of the length of the burner. However, it is also possible for the proposed fuel lance to be used for a premix burner with vortex breakdown that additionally has a downstream mixing section (cf. in this respect, by way of example, EP 0704657).

The fuel lance is usually circular in cross section. A middle tube 4, as well as a further, inner tube, the oil tube 3, having the smallest diameter, are usually arranged inside and coaxially with the cylindrical outermost tube 2. Liquid fuel, i.e. oil 6, gasoline or the like, flows through the oil tube 3 in the oil routing 5 to the lance tip 1 when the fuel lance will be operated with liquid fuel 6. At the tip of the oil tube 3 there is a central insert 7 that is arranged substantially on the axis of the burner lance and causes the oil stream to be diverted radially outward at the lance tip 1. As a result, the liquid fuel does not pass into the combustion chamber or the cavity in which the combustion is to take place in the direction of the axis of the fuel lance, but rather in the form of a conical spray cone that may be designed to be continuous, i.e. encircling, all the way around. The liquid fuel can also be injected at this location through a multi-hole nozzle or a hollow-cone swirl nozzle (not illustrated in the figures).

Gaseous fuel usually flows to the lance tip 1 in the cavity between the outermost tube 2 and the middle tube 4. In this case, at its outermost end the outer tube 2 has an encircling curvature, i.e. narrowing, in the direction of the axis of the fuel lance, with the result that the gas stream is diverted toward the axis of the fuel lance shortly before emerging from the fuel lance. In other words, a conically tapering, hollow gas cone is formed.

In the space 8 between the middle tube 4 and the oil tube 3, according to the invention purge air 9 flows to the lance tip 1. This purge air 9 is flowing substantially axially, i.e. so as to form a cylindrical air jacket at the lance tip 1. In other words, the purge air 9 flows between the two fuels used. According to the invention, it is such that both the gaseous fuel stream 11 and the liquid fuel 6 are directed onto this cylindrical jacket of purge air 9. This particular arrangement allows operation in which, on account of the shielding of the fuel streams by the purge air 9, the lance can be operated either with one of the two fuels 6, 11 or with both fuels without, for example in the case of operation with just one fuel, there being any risk of fuel 6, 11 being able to pass from the actuator fuel passage into the unoperated fuel passage (no return flow of fuel).

A fuel lance of this type typically has an external diameter in the range from 20 to 40 millimeters (external diameter of the outermost tube 2), the middle tube 4 has an external diameter of approximately ⅔ of that of the outermost tube 2, and the oil tube 3 has a diameter of approximately ⅓ of that of the outermost tube 2. On the lance base 17, the lance generally has a larger external diameter, in the range from 30 to 60 millimeters. The tubes are advantageously made from nickel-base alloys with a wall thickness in the range from 1 to 3 millimeters. The outer tube 2, which in the front region has a curvature toward the inside, is narrowed there by in the region of 40% over a length of 10 millimeters, which is responsible for diverting the pilot gas 11 toward the central axis of the fuel lance, so that the outlet opening of the pilot gas 11 comes to lie at a position which is such that the maximum shielding action of the purge air 9 is achieved.

It is customary for a fuel lance of this type to be used for pilot operation of premix burners. If possible, only gaseous fuel 11 is used in pilot operation, with the fuel lance typically being used up to a load of approximately 50%, i.e. until the premix flame has been sufficiently stabilized. Once the premix flame has been sufficiently stabilized, the fuel lance is normally no longer operated with fuel, but rather only the fuel nozzles at the inlet slots of the premix burner are actuated.

If there is then, for example, no gaseous fuel 11 available, the fuel lance according to the invention, as an alternative, allows the burner to be operated using liquid fuel 6. This alternative option is possible since the purge air 9 prevents the fuel that is employed during operating with just one fuel from entering the passage that is not operating, where it could lead to flashbacks. Moreover, the jacket of purge air 9 has the advantage, in the case of liquid fuel 6, of avoiding coking.

Figure 2:
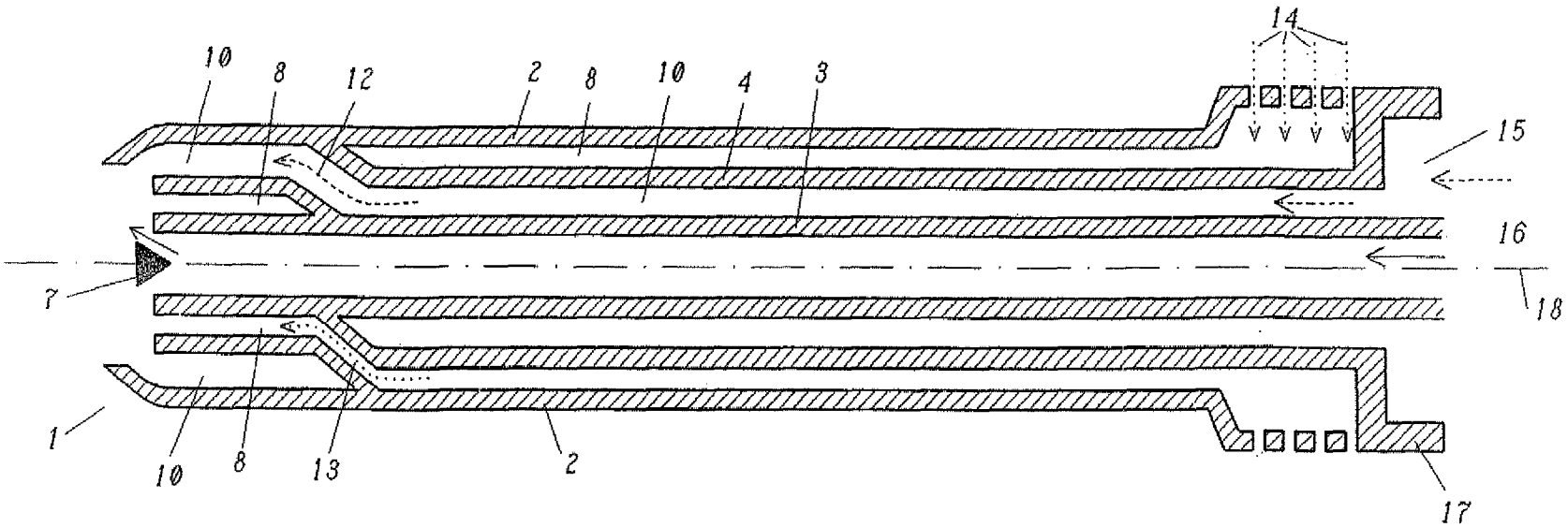
FIG. 2 shows an axial section through an entire fuel lance according to the invention, in which the crossover is arranged at the lance tip.

FIG. 2 shows a lance over its entire length. Since the liquid fuel and the gaseous fuel 6, 11 are usually supplied at the lance base 17 of the burner in a pilot gas inlet 15 and an oil inlet 16, the fundamental problem exists of routing the purge air 9 between these two fuel passages. This can be achieved in two different ways; FIG. 2 shows the option in which from the lance base 17, the two fuels are initially routed in concentric tubes until they reach the region of the lance tip 1, and the purge air 9 is routed in a further space between the middle tube 4 and an outer tube 2 until this region is reached. The purge air 9 is in this case introduced into the space between the middle tube 4 and the outermost tube 2 through openings at 14 in the region of the lance base 17. This purge air 9 is usually sucked in from a region behind the burner. The inlet openings may in this case be configured as slots, but to prevent dirt particles from entering it has proven advantageous for these openings to be configured as bores, usually with a diameter in the range from 2 to 4 millimeters. Then, in the region of the lance tip 1, on one side the pilot gas routing 10 is routed into the radially outermost space by the two outer passages crossing over in a region 12. In this case, in region 13 the purge air 9 routed in the outermost space between the tubes 2 and 4 is routed into the middle space 8 between middle tube 4 and inner oil tube 3. This alternating routing is effected in segments (with respect to the cross-section perpendicular to the axis of symmetry 18 of the fuel lance), in which context three segments for the gas routing and three segments for the purge-air routing are sufficient, in which case the segments typically have the same cross-section.

The routing of the purge air 9 in the outermost space as far as the region of the lance tip 1 as illustrated in FIG. 2 has the advantage that the lance is well cooled by this purge-air duct as a result. Therefore, this lance is suitable in particular if the burner is at a certain risk of flashbacks.

Figure 3:
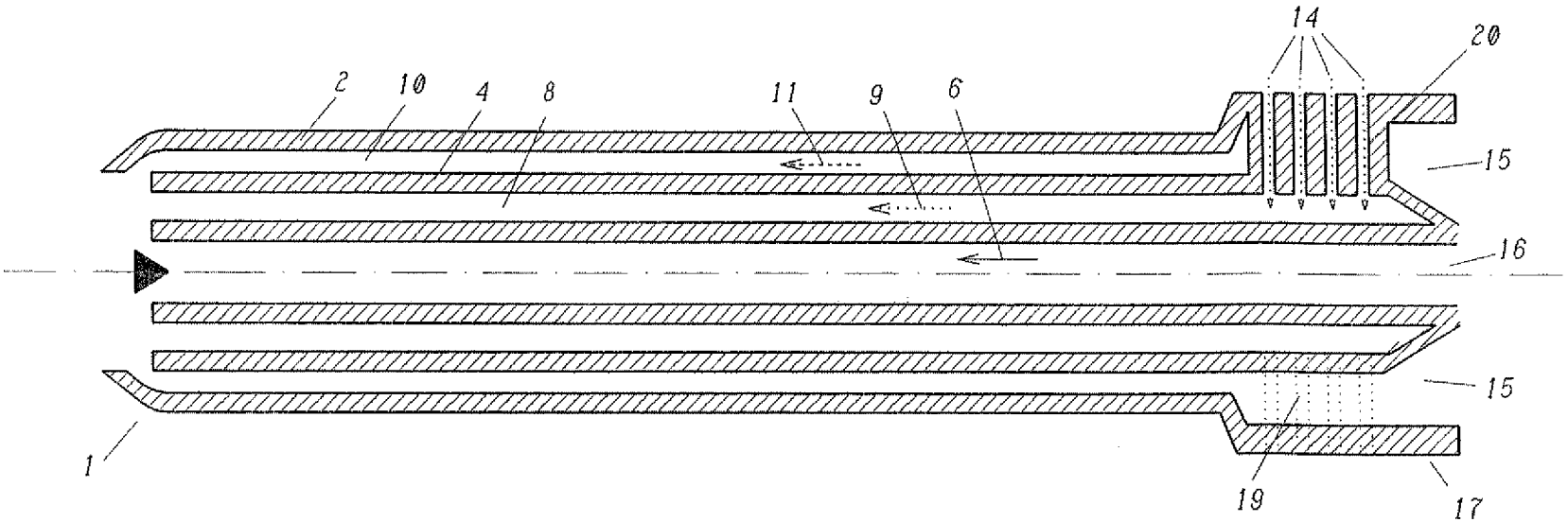
FIG. 3 shows an axial section through a fuel lance according to the invention in which the crossover is arranged at the lance base.

FIG. 3 shows a different exemplary embodiment of a fuel lance for pilot operation, in which the purge air passage and pilot gas passage do not cross 19, 20 at the lance tip, but rather as early as at the lance base 17. In other words, the purge air 9 introduced is routed into the space between middle tube 4 and oil tube 3 as early as at the lance base 17, and accordingly the pilot gas inlet 15 is already passed into the space between middle tube 4 and outermost tube 2 at the lance base 17. Once again, this is done in segments, i.e. the inlet 14 of purge air 9 takes place through slots or bores in three segments, and the pilot gas is routed into the outermost passage in a further three segments. In this case too, it has proven advantageous to provide bores for the inlet 14 of the purge air 9 in order to prevent dirt particles from gaining access.

The exemplary embodiment shown in FIG. 3 has the advantage that, on account of the larger diameter of the fuel lance at its lance base 17, larger cross-sections of flow for the pilot gas and the purge air become possible than if the crossing takes place at the lance tip. Accordingly, with a fuel lance of this nature it is possible to realize greater streams of purge air 9 and pilot gas 11.

LIST OF DESIGNATIONS

| | |
|---|---|
| 1 | Lance tip |
| 2 | Outermost lance tube |
| 3 | Oil tube |
| 4 | Middle tube |
| 5 | Oil routing |
| 6 | Oil, liquid fuel |
| 7 | Central insert |
| 8 | Middle space |
| 9 | Purge air |
| 10 | Pilot gas routing |
| 11 | Pilot gas, gaseous fuel |
| 12 | Area of the pilot gas routing 10 |
| 13 | Area of the purge-air routing |
| 14 | Inlet of the purge air 9 into the purge-air routing (middle space 8) |
| 15 | Pilot gas entry |
| 16 | Oil entry |
| 17 | Lance base |
| 18 | Axis of symmetry of the lance |
| 19 | Crossing of the pilot gas routing 10 |
| 20 | Crossing of the purge-air routing |

What is claimed is:

1. An apparatus for injecting a fuel/air mixture into a combustion chamber comprising:

a fuel lance having a lance tip, a central inner tube, middle and outer tubes arranged concentrically with respect to the inner tube, and an insert disposed along a central axis of the fuel lance proximate the lance tip;

wherein opposing walls of the inner and middle tubes proximate the lance tip form a substantially hollow, cylindrical, first duct portion;

wherein an inner wall of the inner tube proximate the lance tip and the insert are configured and dimensioned to together provide a second duct portion directed slightly radially outward forming a truncated circular cone which opens out toward the lance tip; and wherein an inner wall of the outer tube proximate the lance tip is configured and dimensioned to provide a third duct portion directed slightly radially inward toward the central axis.

2. The apparatus of claim 1, wherein the fuel lance is circular in cross-section.

3. The apparatus of claim 1, wherein the middle tube has a first external diameter and the outer tube has a second external diameter, the first external diameter being approximately two-thirds of the second external diameter.

4. The apparatus of claim 1, wherein the central inner tube has a first external diameter and the outer tube has a second external diameter, the first external diameter being approximately one-third of the second external diameter.

5. The apparatus of claim 1, wherein the tubes are formed of nickel-base alloys.

6. The apparatus of claim 1, wherein each of the tubes has a wall thickness between 1 and 3 millimeters.

7. The apparatus of claim 1, wherein the fuel lance further comprises a lance base and a plurality of openings arranged in radial segments of the outer tube proximate the lance base.

8. The apparatus of claim 7, wherein the openings are slots.

9. The apparatus of claim 7, wherein the openings are bores.

10. The apparatus of claim 9, wherein the bores each have a bore diameter of between 2 and 4 millimeters.

11. The apparatus of claim 1, wherein the insert is symmetric about the central axis.

12. The apparatus of claim 11, wherein the insert comprises a triangular cross-section.

13. The apparatus of claim 1, wherein the insert is partially disposed within the inner tube.

14. The apparatus of claim 1, wherein the insert is completely disposed within the outer tube.

15. The apparatus of claim 1, wherein the fuel lance is arranged on an axis of a premix burner.

16. The apparatus of claim 15, wherein the premix burner comprises a double-cone burner with downstream mixing section.

17. The apparatus of claim 15, wherein the premix burner comprises a double-cone burner without a downstream mixing section.

18. The apparatus of claim 15, wherein the fuel lance has a first length and the premix burner has a total length, with the first length being about three-quarters of the total length.

19. An apparatus for injecting a fuel/air mixture into a combustion chamber comprising:

a fuel lance having a lance tip, a central inner tube, middle and outer tubes arranged concentrically with respect to the inner tube, and an insert disposed along a central axis of the fuel lance proximate the lance tip;

wherein opposing walls of the inner and middle tubes proximate the lance tip form a cylindrical, first duct portion;

wherein an inner wall of the inner tube proximate the lance tip and the insert are configured and dimensioned to together provide a second duct portion directed radially outward forming a truncated circular cone which opens out toward the lance tip; and wherein opposing walls of the outer and middle tubes proximate the lance tip are configured and dimensioned to provide a third duct portion directed radially inward toward the central axis.

20. The apparatus of claim 19, further comprising a premix burner, wherein the fuel lance is arranged on an axis of the premix burner.

* * * * *